US010724734B2

(12) United States Patent
English et al.

(10) Patent No.: US 10,724,734 B2
(45) Date of Patent: Jul. 28, 2020

(54) MULTIPLE PASS FLEXIBLE WATER TUBE BOILER

(71) Applicant: English Boiler, LLC, Henrico, VA (US)

(72) Inventors: John R. English, Mechanicsville, VA (US); Sundeep Bodapati, Richmond, VA (US)

(73) Assignee: Superior Boiler, LLC, Henrico, VA (US)

( * ) Notice: Subject to any disclaimer, the term of this patent is extended or adjusted under 35 U.S.C. 154(b) by 120 days.

(21) Appl. No.: 15/887,938

(22) Filed: Feb. 2, 2018

(65) Prior Publication Data

US 2018/0320890 A1 Nov. 8, 2018

Related U.S. Application Data

(60) Provisional application No. 62/453,558, filed on Feb. 2, 2017.

(51) Int. Cl.

| | |
|---|---|
| ***F22B 21/04*** | (2006.01) |
| ***F22B 21/10*** | (2006.01) |
| ***F22B 19/00*** | (2006.01) |
| ***F22B 21/24*** | (2006.01) |
| ***F22B 21/34*** | (2006.01) |
| ***F22B 21/08*** | (2006.01) |

(52) U.S. Cl.

CPC ..... *F22B 19/00* (2013.01); *F22B 21/08* (2013.01); *F22B 21/24* (2013.01); *F22B 21/34* (2013.01)

(58) Field of Classification Search

CPC ..... F22B 21/126; F22B 15/00; F22B 21/04; F22B 21/083; F22B 21/10; F22B 21/34

See application file for complete search history.

(56) References Cited

U.S. PATENT DOCUMENTS

| | | | | | |
|---|---|---|---|---|---|
| 2,648,316 | A * | 8/1953 | Marshall | F22B 37/207 | 122/331 |
| 3,022,774 | A * | 2/1962 | Hamilton | F22B 37/207 | 122/478 |
| 4,993,368 | A * | 2/1991 | Jones | F22B 21/24 | 122/235.23 |
| 5,050,542 | A * | 9/1991 | Cooke | F22B 21/24 | 122/235.15 |
| 6,817,319 | B1 * | 11/2004 | Manay | F22B 21/366 | 122/235.11 |
| 6,901,887 | B2 * | 6/2005 | English | F22B 21/083 | 122/235.19 |
| 7,137,360 | B1 * | 11/2006 | Zorzit | F22B 13/04 | 122/235.11 |
| 7,334,542 | B2 * | 2/2008 | Zorzit | F22B 21/346 | 122/235.11 |
| 9,404,650 | B2 * | 8/2016 | Lapierre | F22B 21/346 | |

FOREIGN PATENT DOCUMENTS

| | | | | |
|---|---|---|---|---|
| CA | 2205452 C | * | 1/2007 | F22B 21/24 |

* cited by examiner

*Primary Examiner* — Gregory A Wilson
(74) *Attorney, Agent, or Firm* — IPCL Group PLC; Anthony Tacconi, Esq.

(57) ABSTRACT

A package multiple pass flexible water tube boiler for converting water to steam. The boiler having an enclosure and diagonally offset upper and lower drums. The drums are connected by a series of staggered or offset water tubes. The water tubes comprise two sets of repeating tubes that are bent to substantially similar but not identical designs. The staggered tube arrangement optimizes heat transfer and minimizes the footprint of the unit.

5 Claims, 6 Drawing Sheets

MULTIPLE PASS FLEXIBLE WATER TUBE BOILER

This application claims priority from U.S. Provisional Patent Application No. 62/453,558 filed on Feb. 2, 2017.

FIELD OF THE INVENTION

The invention relates to package water tube boilers, and more specifically, smaller commercial flexible water tube boilers.

BACKGROUND OF THE INVENTION

Boilers are used in a variety of applications and processes in the world today. One of the more common types of boilers, the water-tube boiler, uses heat from fuel burned within a combustion chamber to heat water circulating through a network of internal tubes. Water-tube boilers typically consist of two principal sections, a radiant section and a convective section. Some boilers are further equipped with a super heater mechanism for, inter alia, applications in which superheated steam is beneficial or required.

Package water-tube boilers are small to mid-sized water tube boilers that are preconstructed and assembled in a factory. These types of boilers can be shipped and installed as a complete unit, including an integrated burner, and do not require much more than fuel and water sources and appropriate ventilation.

A fundamental advantage of package boilers is an installed cost which is considerably lower than that of a field-erected boiler. This cost advantage is made possible by basic designs that allow standardized fabrication processes while still providing sufficient flexibility to permit satisfactory adaptation to the specific needs of a particular application. As a result, package boilers are typically constructed using standard, industry wide designs. Three of the most prevalent designs of package boilers are the "A", "D", and "O" types so named based upon the approximate shape of their respective tubes. In the conventional designs, the mud and steam drums are typically aligned. The drums may, however, be offset as disclosed in U.S. Pat. No. 6,901,887. The offset drum arrangement offers multiple advantages, including, maximizing heat transfer, better control and reduction of NOx emissions, and easier shipping of the pre-constructed unit. Through a modification of the tube arrangement and/or the addition of baffles, a multi-pass boiler can also be created.

The configuration of the tubes connecting the lower drum to the upper drum is especially important in a package boiler. These tubes must not only convey saturated steam and water to the upper drum, but must also adequately cool the unit and the walls in order for the boiler to have its small size. This is an important point as the space available within the unit for insulation is limited.

It would be advantageous to provide a package boiler with the highest operational efficiency while maintaining the smallest footprint. It is further desirable to accomplish such goals while reducing the overall manufacturing costs of the boiler unit.

DESCRIPTION OF THE DRAWINGS

FIG. 1(*b*) is a transverse view showing a second set of water tubes.

DETAILED DESCRIPTION

Figure 2:
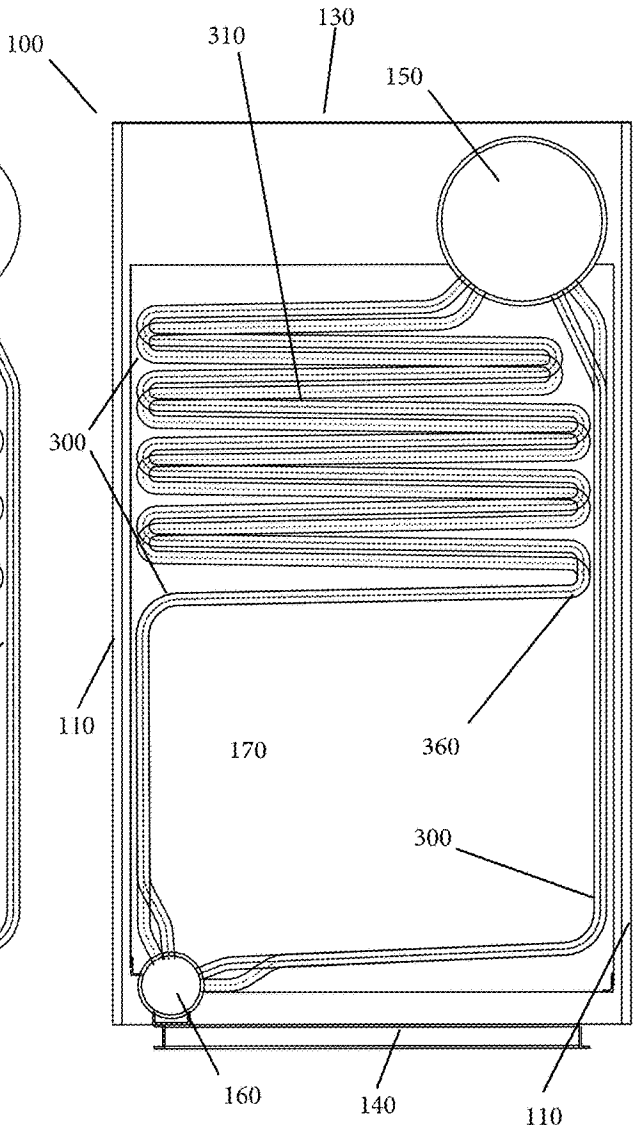
FIG. 2 is a transverse view of a water tube boiler unit having both the first and second set of water tubes installed.
Figure 5:
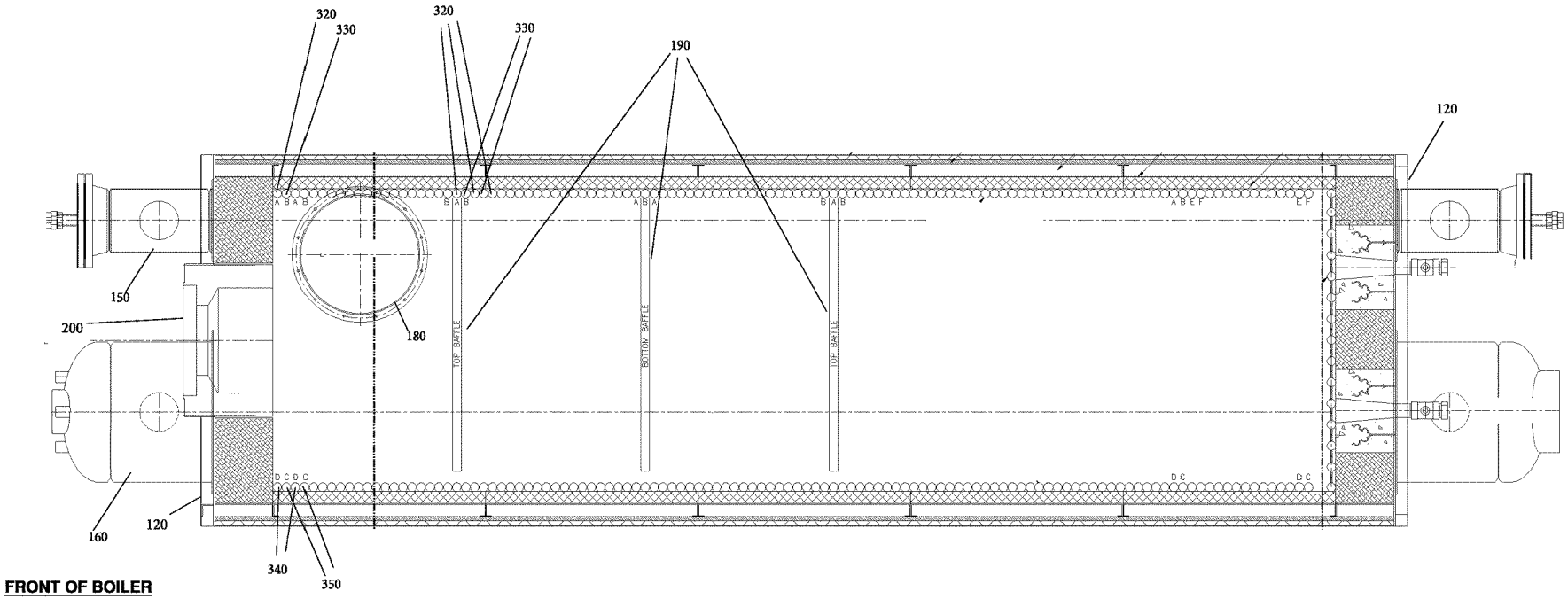
FIG. 5 is a horizontal cross section of an embodiment of water tube boiler unit.

The invention comprises a multiple pass flexible water tube boiler 100 having a novel tube design. FIG. 2 is a transverse section of a water tube boiler unit having such a tube design. The boiler includes a housing having four walls which, inter alia, reduce thermal loss. Sidewalls 110 are connected to end walls 120, top surface 130, and bottom surface 140. As shown in FIG. 2, an upper drum 150, a lower drum 160, and a plurality of conduits 300, i.e., metal tubes, are disposed within the housing. The drums 150 and 160 may be made of steel or any analogous material. Lower water drum 160 and upper steam drum 150 may be aligned within the housing. In the preferred embodiment, however, the drums 150 and 160 are offset from one another as disclosed in U.S. Pat. No. 6,901,887. In essence, the lower drum 160 is located in a lower corner, and the upper drum 150 is diagonally located in the upper corner as seen in FIGS. 2 and 5.

A plurality of metal water tubes 300 connect the lower drum 160 to the upper drum 150. A combustion chamber 170 is defined by the lower portion of the tubes 300. The upper portion of the tubes reside in a convection section 310 of the boiler. Gas outlet 180 allows the exhaust gas to escape.

One or more external downcomers (not shown) may be used to transport cooler water from the upper drum to the lower drum. When downcomers are used, the offset drum arrangement facilitates the connection of the downcomer to a flange on the header of the lower drum and the connection is not otherwise hindered by the burner arrangement.

Figure 1B:
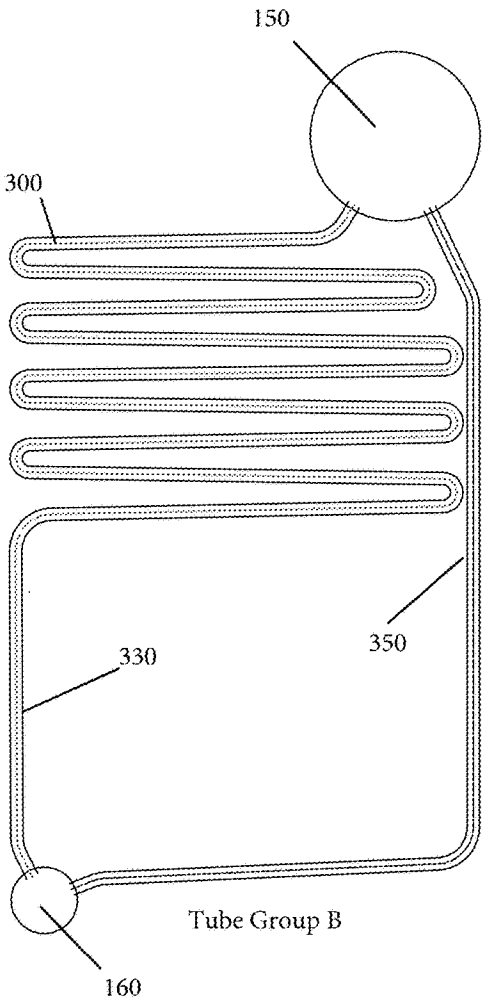
FIG. 1(*a*) is a transverse view showing a first set of water tubes.
Figure 1A:
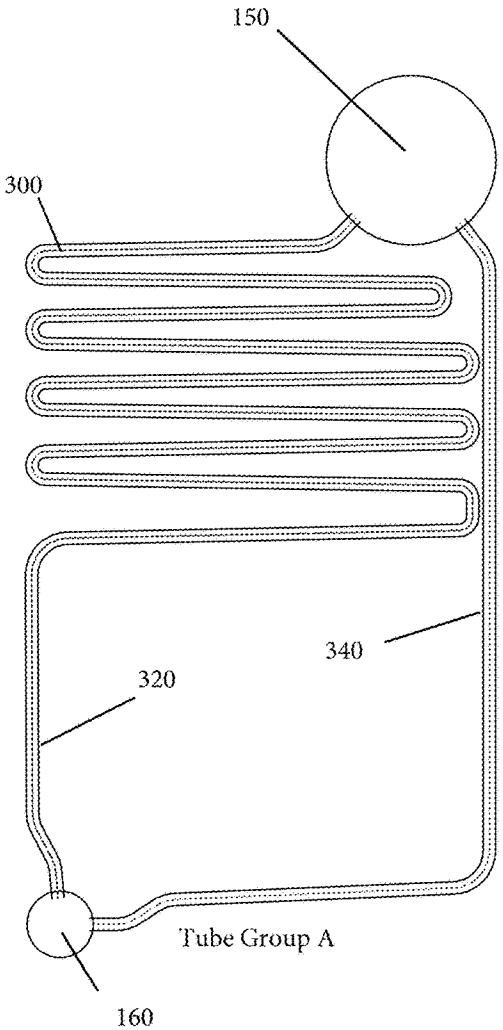

The invention incorporates a parallel series of staggered water tubes 300, arranged in two groups of repeating tubes, along the long axis of the drums 150, 160. Referring to FIG. 1(*a-b*), the conduits 300 are comprised of a first set of water tubes Group A, shown in FIG. 1(*a*), and a second set of water tubes Group B, shown in FIG. 1(*b*) which are positioned in a generally staggered or interlocking arrangement when installed in the boiler unit 100, as shown in FIGS. 2 and 5

Figure 6:
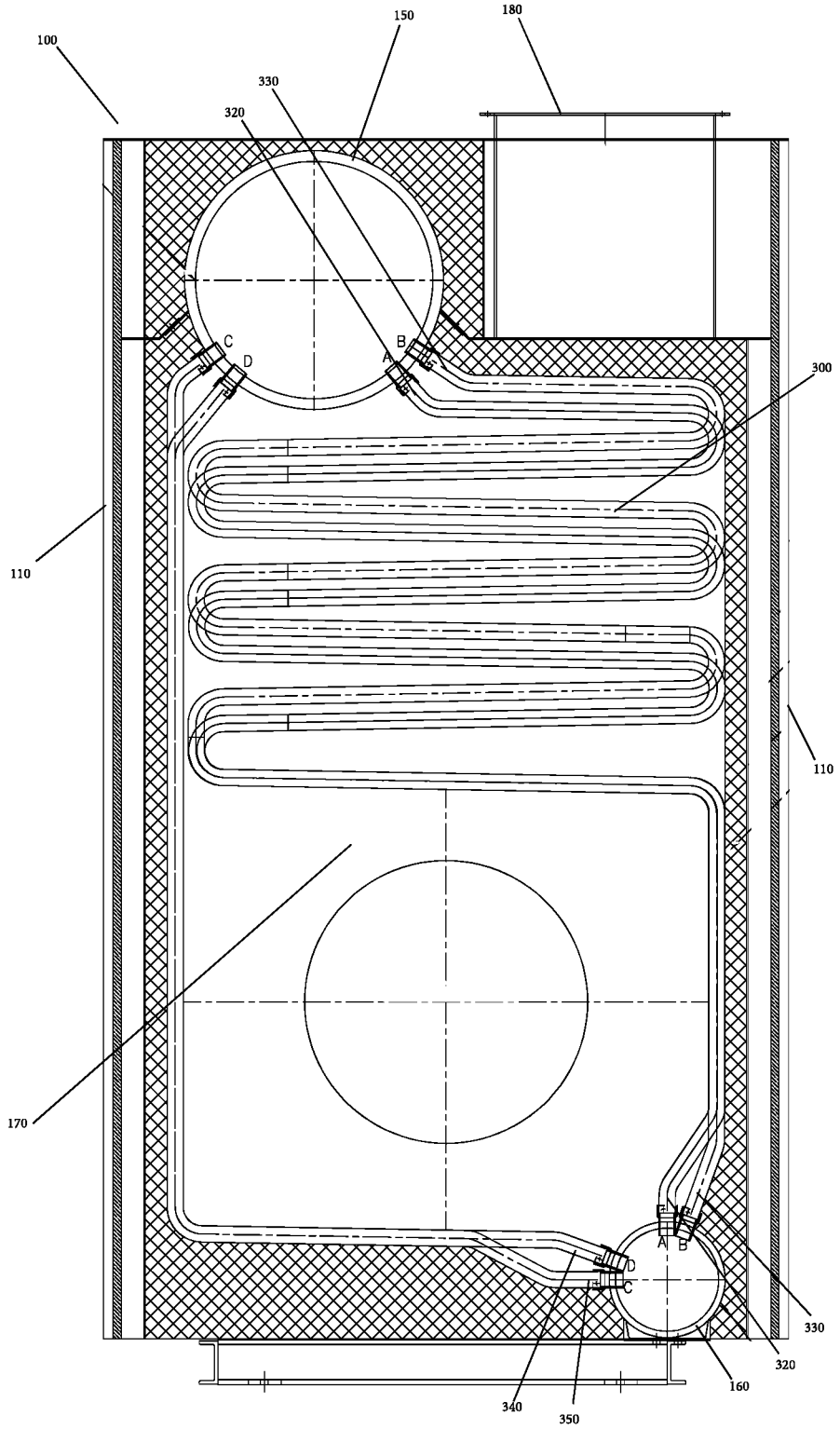
FIG. 6 is a transverse view of an alternate embodiment of water tube boiler unit.
Figure 7:
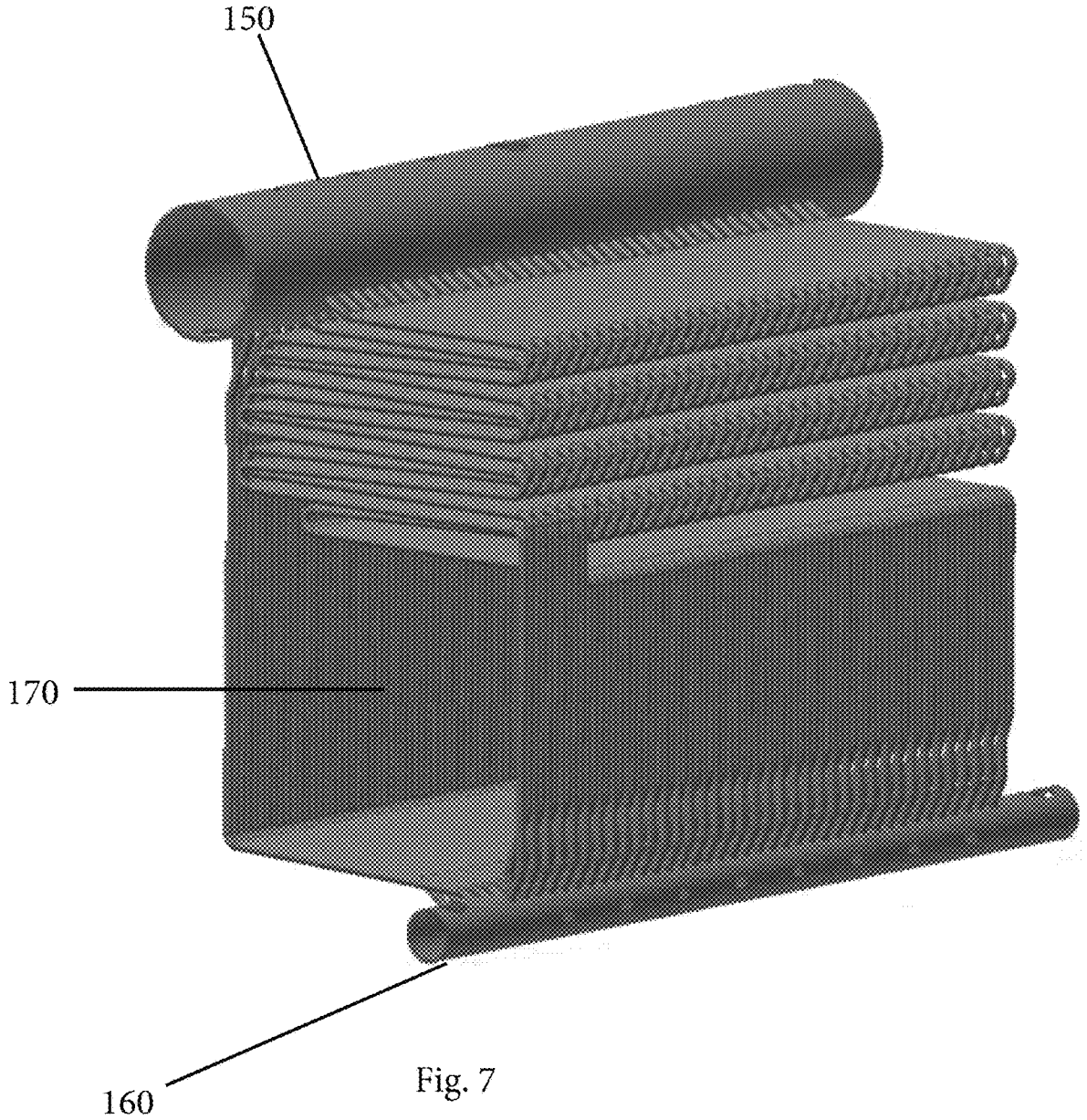
FIG. 7 is an isometric view of the drum and tube assembly.

Referring now to FIGS. 5 and 6, the first tube grouping consists of tubes 320 and 340 and the second grouping consists of tubes 330 and 350. This sequence of tubes, i.e., tubes 320, 340 and then tubes 330, 350, can then be repeated within the enclosure until the desired number of water tubes is attained. One of the preferred embodiments of the boiler 100 would have a total of seventy-four tubes, i.e. thirty seven tubes per set, but it will be recognized that the aggregate number of tubes within the unit 100 could be adjusted as desired.

As seen in FIG. 1, tube 320 of set one and tube 330 of set two are essentially the same shape and, tube 340 of set one and tube 350 of set two are of essentially the same shape. It will be noted that the shape of the tubes in each group only varies at (i) the junction with the lower drum, (ii) the first bend 360 entering the convection zone, and (iii) the upper corner where tubes 340 and 350 are bent at different angles to connect to the upper drum. At the first bend 360, tube 320 bends at a wider angle than tube 330, i.e., the tube of set one is offset in an upward direction, which permits the two sets of tubes to be staggered for most of their passage from the lower drum 200 to the upper drum 100 within the convection zone 310. The tubes 300 are composed of carbon steel or analogous material.

It will also be noted that although Group A and Group B have substantially the same design, due to the difference in the first bend in these two tube groups, their horizontal runs will not be situated parallel, i.e., within the same horizontal plane, within the boiler 100. This allows for a staggering of the water tubes which is a design not found in a conventional boiler. In a conventional boiler, all, or substantially all, of the riser tubes are of identical design and mounted in an identical position, yielding a generally uniform arrangement of tubes from the front to the back of the boiler.

Figure 8:
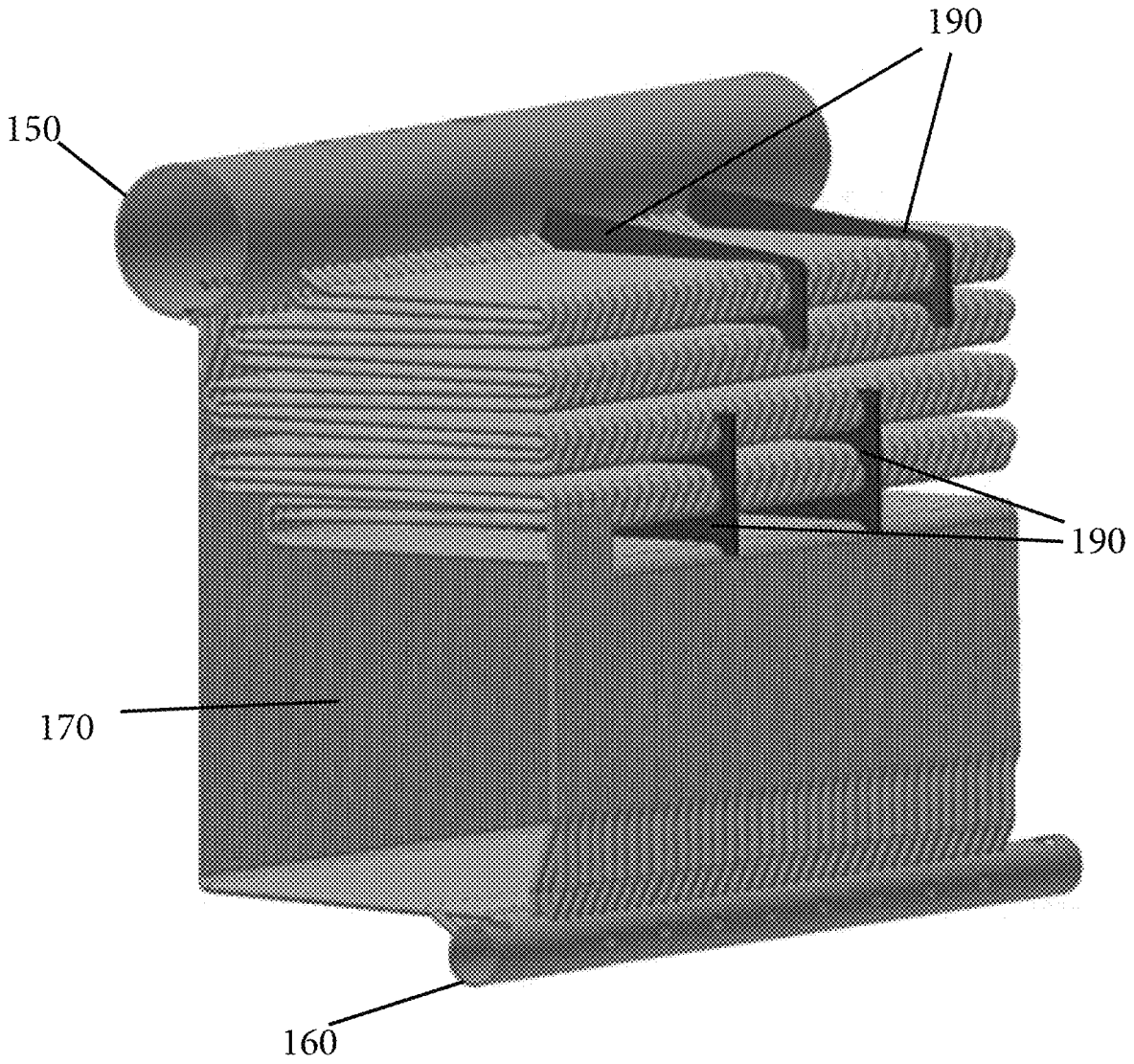
FIG. 8 is an alternate view of the drum and tube assembly.

In the instant arrangement, the tight interlocking nature of the tubes prevents gases from traveling between the radiant and convection sections of the boiler 100 and further increases the efficiency of the unit. The boiler can, however, also be operated as a multiple pass boiler via the installation of baffles within the convection section. Specifically, one or more baffles 190, such as shown in FIGS. 5 and 8, can be installed to control the flow of gases so that the gases can be directed to make multiple passes over the tubes prior to discharge from the enclosure. Insulation (not shown) may be present within the housing, where required, to further prevent gas leakage or thermal loss.

Figure 4:
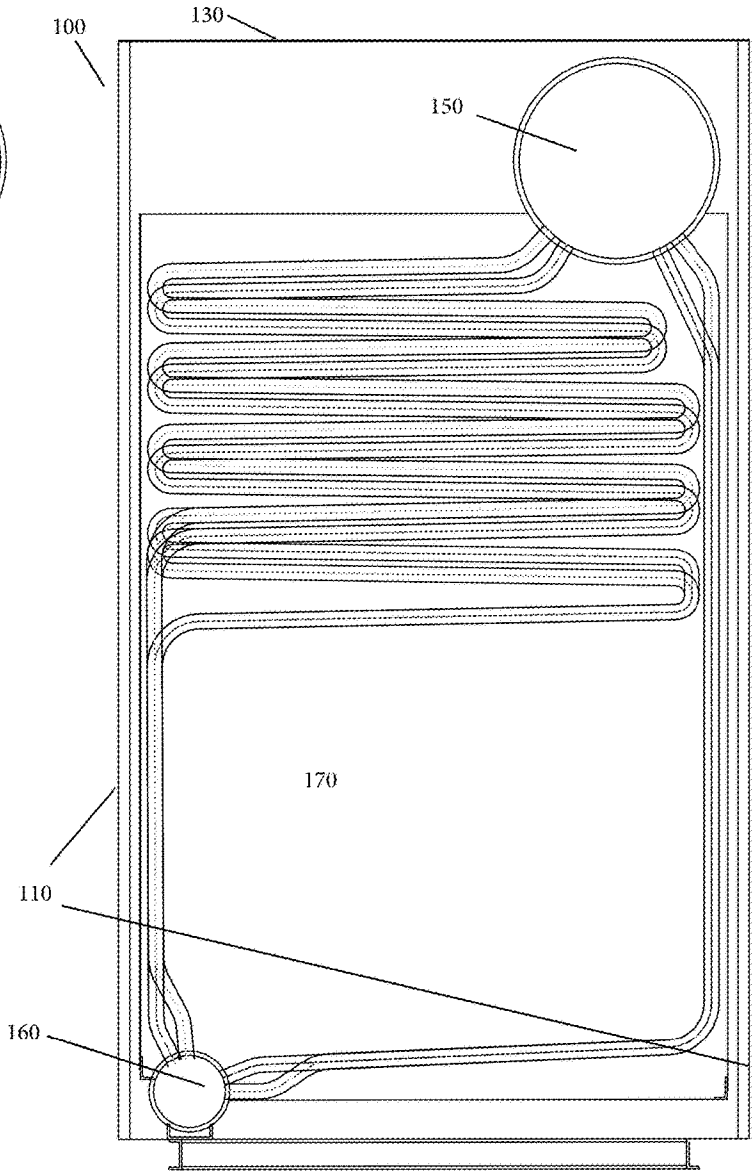
FIG. 4 is a transverse view of a water tube boiler unit having the alternate configuration installed.
Figure 3:
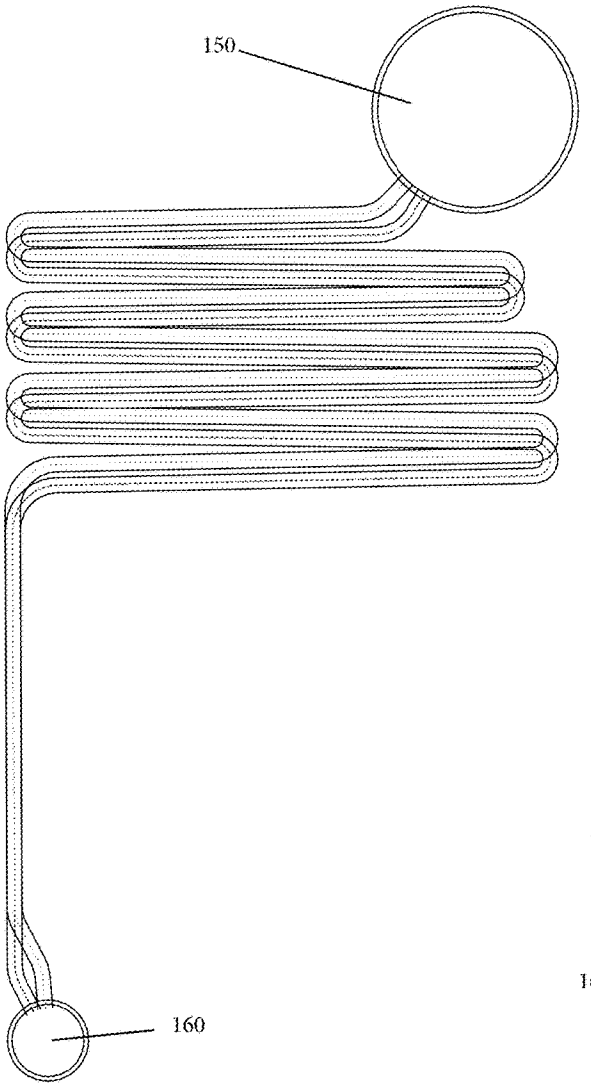
FIG. 3 is a transverse view of an alternate configuration of water tubes.

In addition, a limited number of tubes, e.g., ten to twelve tubes, are bent slightly differently than the main body of riser tubes 300 in order to allow flue gas from the combustion chamber 400 to enter the convection section 310. These tubes, located near the far or back end of the furnace, are shown in FIGS. 3 and 4.

In operation, the burner 200 injects air and atomized fuel in the combustion chamber creating a flame which extends through the combustion chamber towards the rear wall. The combustion gases pass through the convection section of the water tubes and, ultimately, exit via the gas outlet 180. The heat absorbed by the water tubes 300 heats the water in the tubes and results in the generation of steam which rises to the upper steam drum 150. Depending on the application, tubes 340 and 350 may also act as downcomer tubes, permitting return of water to the lower drum 160.

The staggered tube arrangement substantially improves heat transfer within the boiler. The total heat transfer surface necessary is less than would be required with a conventional water tube arrangement. Therefore, a boiler having the instant configuration and a smaller footprint would be able to maintain the same operational parameters as a boiler having a conventional tube arrangement and, by extension, a larger footprint.

A boiler unit designed in this fashion has a quick response time and can generally be brought online in minutes. Because the unit uses only four tubes per section, the unit can be made to operate at a higher capacity and higher pressure than a conventional unit having ten or more such tubes. Further, this design permits the installation of a radiant superheater within the combustion chamber for additional industrial applications.

Overall manufacturing costs are reduced when employing this design, as the designs of tube set A and tube set B are essentially identical, except for the differences noted above. Costs are therefore reduced because other than those minimal differences, the same tubes are being manufactured and installed.

While the invention has been described in reference to certain preferred embodiments, it will be readily apparent to one of ordinary skill in the art that certain modifications or variations may be made to the system without departing from the scope of invention claimed below and described in the foregoing specification.

What is claimed is:

1. A multiple-pass flexible water tube boiler comprising:

an enclosure formed by a first side wall, a second side wall, a front wall, a rear wall, a top surface and a bottom surface; said enclosure having a convection section and a radiant section;

a cylindrical upper steam drum having its longitudinal axis proximate to said second side wall;

a cylindrical lower water drum having its longitudinal axis proximate to said first side wall;

offset boiler tubes connecting, and allowing communication between, said lower drum and said upper drum wherein said tubes comprise:

(i) a first group of two water tubes being in the same plane and varying in shape; said first group comprising a first tube exiting said lower drum extending laterally in a horizontal run toward said second wall then upward in a vertical run to an entrance in said upper drum, and a second tube exiting said lower drum and extending upward in a vertical run along said first side wall, then turning to execute one or more horizontal runs by extending horizontally along a longitudinal center line toward a side wall and then turning and running horizontally again and repeating until said second tube terminates at an entrance to said upper drum; and, (ii) a second group of two water tubes being in the same plane and varying in shape; said second group comprising a third tube exiting said lower drum, extending laterally in a horizontal run toward said second wall, then upward in a vertical run to an entrance in the upper drum, and a fourth tube exiting said lower drum and extending upward in a vertical run along said first side wall, then turning to execute one or more horizontal runs by extending horizontally along a longitudinal center line toward a side wall and then turning and running horizontally again and repeating until said fourth tube terminates at an entrance to said upper drum, wherein said longitudinal center lines of said fourth tube during horizontal runs are essentially parallel to said longitudinal center lines of said second tube during horizontal runs but are offset in an upward direction; and, a combustion chamber defined by a portion of said boiler tubes.

2. The water tube boiler of claim 1 further comprising a plurality of offset boiler tubes wherein said tubes comprise repeating sections of said first group and said second group of water tubes arranged in parallel within said enclosure.

3. The water tube boiler of claim 1 further comprising a burner in communication with said combustion chamber.

4. The flexible water tube boiler of claim 1 wherein said enclosure possesses a centerline which is equidistant from said first wall and said second wall, and, further, said horizontal runs of said second tube cross said centerline and said horizontal runs of said fourth tube cross said centerline.

5. The flexible water tube boiler of claim 1 further comprising at least three baffles positioned within the convection section of the boiler which direct the flow of gas so as to allow the gas to make multiple passes over the boiler tubes.

* * * * *